US010601162B2

(12) United States Patent
Ho

(10) Patent No.: US 10,601,162 B2
(45) Date of Patent: Mar. 24, 2020

(54) ELECTRICAL CONNECTOR

(71) Applicant: LOTES CO., LTD, Keelung (TW)

(72) Inventor: Chien Chih Ho, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/351,947

(22) Filed: Mar. 13, 2019

(65) Prior Publication Data

US 2019/0288425 A1 Sep. 19, 2019

Related U.S. Application Data

(60) Provisional application No. 62/642,751, filed on Mar. 14, 2018.

(30) Foreign Application Priority Data

Dec. 11, 2018 (CN) ..... 2018 1 1513250

(51) Int. Cl.
*H01R 13/24* (2006.01)
*H01R 13/41* (2006.01)
(Continued)

(52) U.S. Cl.
CPC ..... *H01R 13/2435* (2013.01); *H01R 12/712* (2013.01); *H01R 13/08* (2013.01);
(Continued)

(58) Field of Classification Search
CPC .. H01R 12/714; H01R 13/2435; H01R 12/52; H01R 12/57; H01R 12/7082;
(Continued)

(56) References Cited

U.S. PATENT DOCUMENTS 3,923,365 A * 12/1975 Lynch ..... H01R 13/41 439/751
4,655,519 A * 4/1987 Evans ..... H05K 7/1069 439/514

(Continued)

FOREIGN PATENT DOCUMENTS

CN 201656033 U 11/2010
CN 201725896 U 1/2011
CN 107394448 A 11/2017

*Primary Examiner* — Edwin A. Leon
*Assistant Examiner* — Matthew T Dzierzynski
(74) *Attorney, Agent, or Firm* — Locke Lord LLP; Tim Tinkang Xia, Esq.

(57) ABSTRACT

An electrical connector is mounted on a circuit board for mating with a chip module. The electrical connector includes: an insulating body, provided with an accommodating hole; a conductive terminal, accommodated in the accommodating hole, and having a conducting portion; and an electrical conductor, provided below the conducting portion to be in contact with the conducting portion and electrically connected to the circuit board. The electrical conductor is received in a receiving groove of the insulating body. The positions of the electrical conductor and the conductive terminal are relatively fixed in a horizontal direction, and the electrical conductor is more wear-resistant. Thus, the electrical conductivity of the electrical conductor will not be affected due to the electrical conductor and the conductive terminal scratching with each other.

14 Claims, 11 Drawing Sheets

(51) Int. Cl.

| | |
|---|---|
| ***H01R 13/08*** | (2006.01) |
| ***H01R 13/15*** | (2006.01) |
| ***H01R 13/64*** | (2006.01) |
| ***H01R 13/73*** | (2006.01) |
| ***H01R 12/71*** | (2011.01) |

(52) U.S. Cl.
CPC ..... *H01R 13/15* (2013.01); *H01R 13/24* (2013.01); *H01R 13/41* (2013.01); *H01R 13/64* (2013.01); *H01R 13/73* (2013.01)

(58) Field of Classification Search
CPC ..... H01R 12/716; H01R 12/73; H01R 13/24; H01R 13/2457; H01R 13/2492; H01R 13/432; H01R 13/646; H01R 13/2442; H01R 13/40; H01R 12/7076; H01R 43/02; H01R 13/2485; H01R 13/6276; H01R 13/6315; H01R 13/6588; H01R 13/6597; H01R 33/18; H05K 2203/041; H05K 7/1069; H05K 3/3426; H05K 3/3436; H05K 2201/042; H05K 2201/10318; H05K 2201/10424
See application file for complete search history.

(56) References Cited

U.S. PATENT DOCUMENTS 4,927,369 A * 5/1990 Grabbe ..... H01R 12/714 439/66
6,155,845 A * 12/2000 Lin ..... H01R 4/028 439/78
6,227,869 B1 * 5/2001 Lin ..... H05K 7/1069 439/515
6,955,545 B1 * 10/2005 Morana ..... H01R 13/112 439/83
7,001,190 B2 * 2/2006 Morana ..... H01R 13/112 439/81
7,160,115 B2 * 1/2007 Huang ..... H01R 13/2435 439/66
7,467,950 B2 * 12/2008 Fan ..... H01R 4/489 439/66
7,553,202 B2 * 6/2009 Ma ..... H01R 12/57 439/839
7,621,755 B2 * 11/2009 Kubo ..... H01R 13/2435 439/66
7,922,548 B2 * 4/2011 Fan ..... H01R 12/57 439/66
8,323,038 B2 * 12/2012 Jin ..... H01R 12/714 439/66
8,708,716 B1 * 4/2014 Ho ..... H01R 12/714 439/83
9,954,312 B1 * 4/2018 Ju ..... H01R 12/707
10,230,177 B2 * 3/2019 Ju ..... H01R 13/2442
10,236,635 B2 * 3/2019 Ju ..... H01R 13/6597
10,389,050 B2 * 8/2019 Huang
2005/0174746 A1 * 8/2005 Hsiao ..... H01R 13/2435 361/769
2008/0050940 A1 * 2/2008 Lin ..... H01R 12/57 439/66
2010/0081329 A1 * 4/2010 Fan ..... H01R 12/57 439/626
2011/0294308 A1 * 12/2011 Kuwata ..... H01R 12/62 439/55
2012/0202384 A1 * 8/2012 Liaw ..... H01R 12/57 439/626
2014/0162472 A1 * 6/2014 Walden ..... H01R 12/714 439/66
2018/0269613 A1 * 9/2018 Ju ..... H01R 12/7076
2018/0331441 A1 * 11/2018 Huang ..... H01R 12/57

* cited by examiner

100

ELECTRICAL CONNECTOR

CROSS-REFERENCE TO RELATED PATENT APPLICATION

This non-provisional application claims priority to and the benefit of, pursuant to 35 U.S.C. § 119(e), U.S. provisional patent application Ser. No. 62/642,751 filed Mar. 14, 2018, and under 35 U.S.C. § 119(a), patent application Serial No. CN201811513250.X filed in China on Dec. 11, 2018. The disclosures of the above applications are incorporated herein in their entireties by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and more particularly to an electrical connector mounted on a circuit board.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Chinese Patent Application No. CN201020129222.0 discloses an electrical connection module for electrically connecting a chip module to a printed circuit board, which includes an electrical connector and a substrate between the electrical connector and the circuit board. The electrical connector includes an insulating body and a plurality of conductive terminals accommodated in the insulating body. The substrate is made of a soft material, where an upper surface thereof is provided with an upper conductive unit contacting the conductive terminal, a lower surface thereof is provided with a lower conductive unit soldered on the printed circuit board through a solder block, and the upper and lower conductive units are connected by a conductive channel. The upper conductive unit protrudes and is exposed on the upper surface of the substrate, and the substrate and the electrical connector are not fixed to each other. When the substrate is mated with and mounted on the electrical connector, the upper conductive unit is easily scratched and worn by the conductive terminal, thereby affecting the electrical connection. The upper and lower conductive units themselves also have the risk of being easily detached from the substrate. Moreover, the upper and lower conductive units overlap each other vertically to form an additional capacitive effect, thereby affecting the impedance of the entire conductive path.

Therefore, a heretofore unaddressed need to design an improved electrical connector exists in the art to address the aforementioned deficiencies and inadequacies.

SUMMARY

In view of the above deficiencies, the present invention is directed to an electrical connector in which a conductive terminal and a circuit board are electrically connected to each other through an electrical conductor.

To achieve the foregoing objective, the present invention adopts the following technical solutions.

An electrical connector is mounted on a circuit board and configured to mate with a chip module, and includes: an insulating body, provided with an accommodating hole; a conductive terminal, accommodated in the accommodating hole, wherein the conductive terminal has a conducting portion; and an electrical conductor, provided below the conducting portion, configured to be in contact with the conducting portion and electrically connected to the circuit board.

In certain embodiments, a lower surface of the insulating body is upward concavely provided with a receiving groove, the receiving groove is located below the accommodating hole and is communicated with the accommodating hole, and the electrical conductor is fixed in the receiving groove.

In certain embodiments, a bottom surface of the accommodating hole is downward concavely formed with a recess gradually shrinking from top to bottom thereof, the recess is communicated with the receiving groove, and the conducting portion enters the recess.

In certain embodiments, the electrical conductor is made of metal.

In certain embodiments, the electrical conductor is connected to the circuit board through a solder.

In certain embodiments, the conducting portion abuts the electrical conductor.

In certain embodiments, a gap is provided between the conducting portion and the electrical conductor, and when the chip module is pressed downward on the conductive terminal, the conductive terminal moves downward, and the conducting portion downward abuts the electrical conductor.

In certain embodiments, the conductive terminal has a base, an upper elastic arm is provided above the base and obliquely extending upward and forward, the upper elastic arm has a contact portion, the contact portion is configured to be in contact with the chip module, a first abutting portion is connected below the contact portion, a lower elastic arm is provided below the base and obliquely extending downward and forward, the lower elastic arm has the conducting portion, and a second abutting portion is connected above the conducting portion.

In certain embodiments, the upper elastic arm has a slot between the contact portion and the first abutting portion, and the lower elastic arm has an opening between the conducting portion and the second abutting portion.

In certain embodiments, an end wall of the accommodating hole is protrudingly provided with a stopping block, the lower elastic arm has a stopping portion connected below the base, the stopping portion protrudes toward the end wall and is located below the stopping block, the accommodating hole is concavely provided with a position limiting groove at one side of the base, and the base is protrudingly provided with a position limiting portion to be accommodated in the position limiting groove.

In certain embodiments, the first abutting portion is in contact with the second abutting portion only when the chip module is pressed downward on the conductive terminal.

Compared with the related art, the electrical connector according to certain embodiments of the present invention has the beneficial effects: the electrical conductor is accommodated in a receiving groove of the insulating body. The positions of the electrical conductor and the conductive terminal are relatively fixed in a horizontal direction, and the electrical conductor is more wear-resistant. Thus, the electrical conductivity of the electrical conductor will not be affected due to the electrical conductor and the conductive terminal scratching with each other. Further, only one electrical connector is used to electrically connect the conductive terminal and a solder or a circuit board, such that an additional capacitive effect is not generated, thus facilitating regulation of the impedance of a conductive path.

An electrical connector is mounted on a circuit board, and includes: an insulating body, provided with an accommodating hole; a conductive terminal, accommodated in the accommodating hole, wherein the conductive terminal has a conducting portion; a flexible substrate, located below the insulating body; and an electrical conductor, provided on the flexible substrate and located below the conducting portion, wherein the electrical conductor is exposed on an upper surface and a lower surface of the flexible substrate to electrically connect the conducting portion and the circuit board.

In certain embodiments, the flexible substrate is formed by two flexible sub-boards attached to each other, the electrical conductor is fixed between the two flexible sub-boards, and the upper surface and the lower surface of the flexible substrate concavely form two grooves toward the electrical conductor to expose the electrical conductor.

In certain embodiments, an upper surface of the electrical conductor is in contact with the conducting portion, and a lower surface of the electrical conductor is soldered to the circuit board through a solder.

In certain embodiments, the insulating body is downward protrudingly provided with a plurality of positioning blocks abutting an edge of the flexible substrate, so as to limit the flexible substrate from moving horizontally.

In certain embodiments, the conductive terminal has a base, an upper elastic arm is provided above the base and obliquely extending upward and forward, the upper elastic arm has a contact portion, the contact portion is configured to be in contact with a chip module, a first abutting portion is connected below the contact portion, a lower elastic arm is provided below the base and obliquely extending downward and forward, the lower elastic arm has the conducting portion, and a second abutting portion is connected above the conducting portion.

Compared with the related art, the electrical connector according to certain embodiments of the present invention has the beneficial effects: the electrical conductor is fixed in the flexible substrate, and the flexible substrate is limited by positioning blocks on the lower surface of the insulating body from moving horizontally. Thus, the positions of the electrical conductor and the conductive terminal are relatively fixed in a horizontal direction, and the electrical conductor is more wear-resistant. Thus, the electrical conductivity of the electrical conductor will not be affected due to the electrical conductor and the conductive terminal scratching with each other. Further, only one electrical connector is used to electrically connect the conductive terminal and a solder or a circuit board, such that an additional capacitive effect is not generated, thus facilitating regulation of the impedance of a conductive path.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
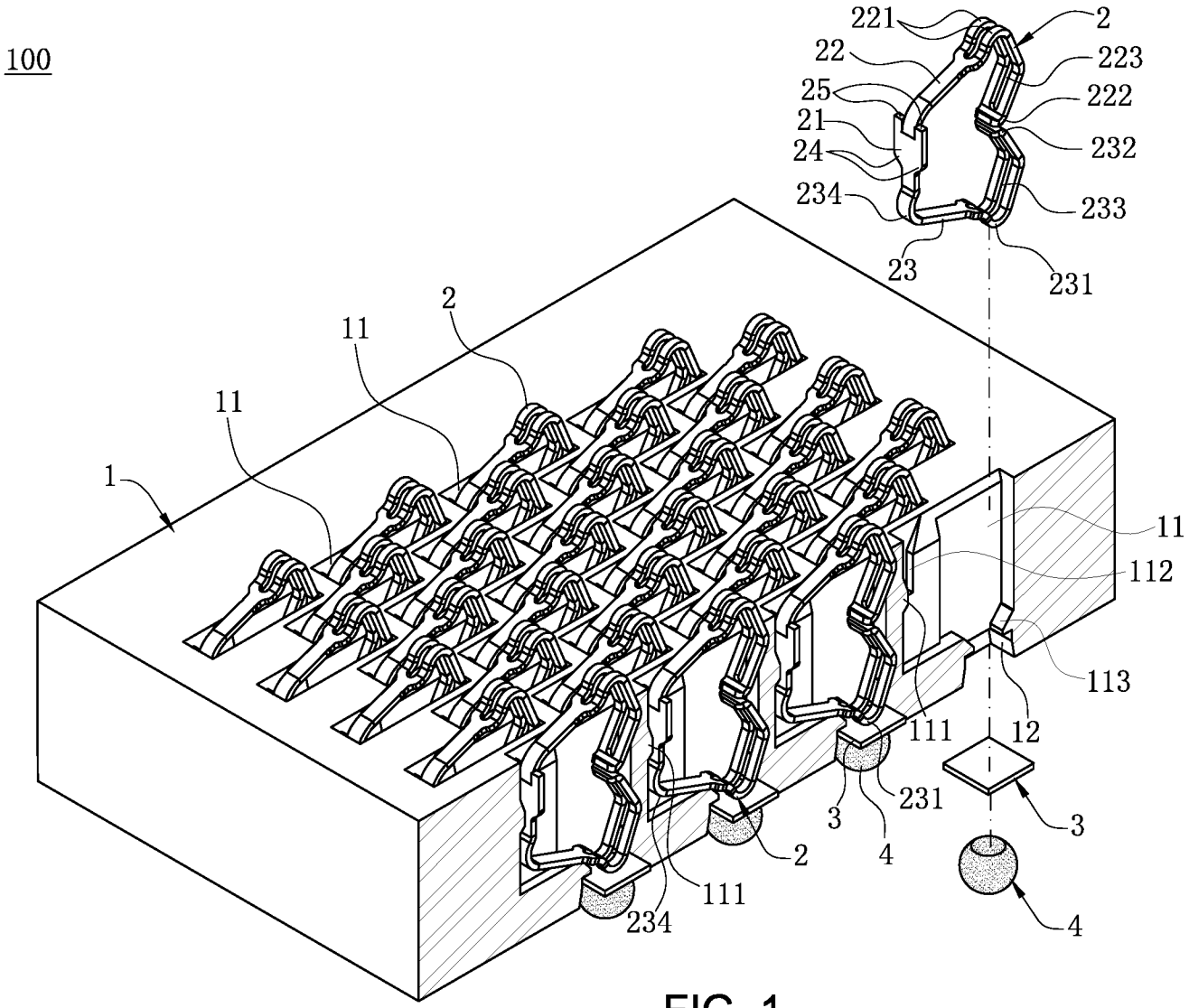
FIG. 1 is a perspective sectional view of an electrical connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-11. In accordance with the purposes of this invention, as embodied and broadly described herein, this invention, in one aspect, relates to an electrical connector.

FIG. 1 to FIG. 4 show an electrical connector 100 according to a first embodiment of the present invention, which is used for electrically connecting a chip module A to a circuit board B. The electrical connector 100 includes an insulating body 1, a plurality of conductive terminals 2 accommodated in the insulating body 1, and a plurality of electrical conductors 3 fixed on the insulating body 1. The electrical conductors 3 one-to-one corresponds to the conductive terminals 2, and are located below the conductive terminals 2. The electrical connector 100 is in contact with the chip module A through the conductive terminals 2. The electrical conductors 3 are in contact with lower ends of the conductive terminals 2. The electrical conductors 3 are connected to the circuit board B through solders 4. In this case, the chip module A is electrically connected to the circuit board B.

Figure 2:
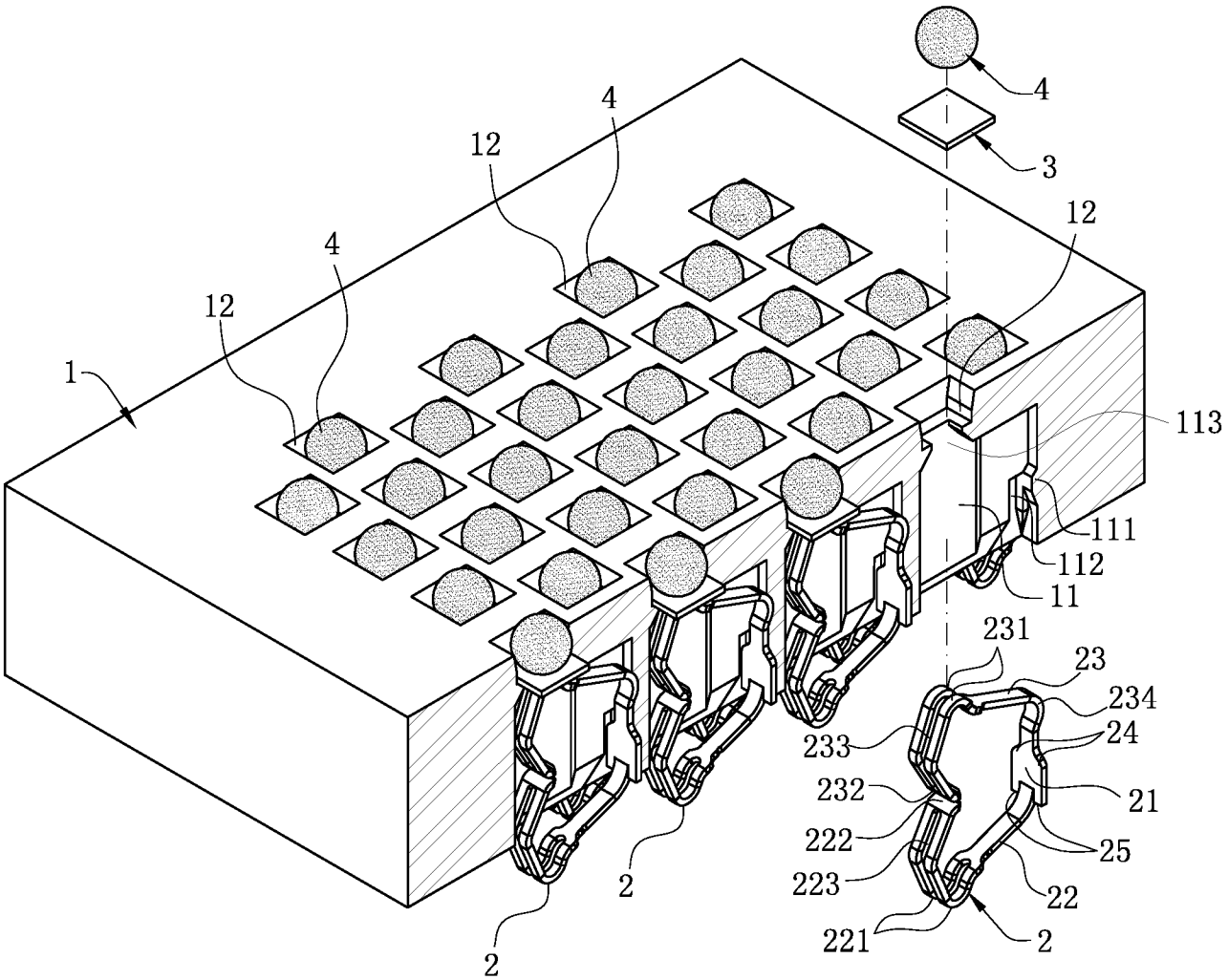
FIG. 2 is a perspective view of the electrical connector of FIG. 1 being 180° inverted.

As shown in FIG. 1 and FIG. 2, the insulating body 1 is made of an insulating material and has a substantially rectangular shape, and has a plurality of accommodating holes 11 downward concavely formed on an upper surface thereof for accommodating the conductive terminals 2, and a plurality of receiving grooves 12 upward concavely formed on a lower surface thereof for accommodating the electrical conductors 3. The accommodating holes 11 and the receiving grooves 12 one-to-one vertically correspond to each other, and the receiving grooves 12 are located below and communicated with the accommodating holes 11.

Figure 3:
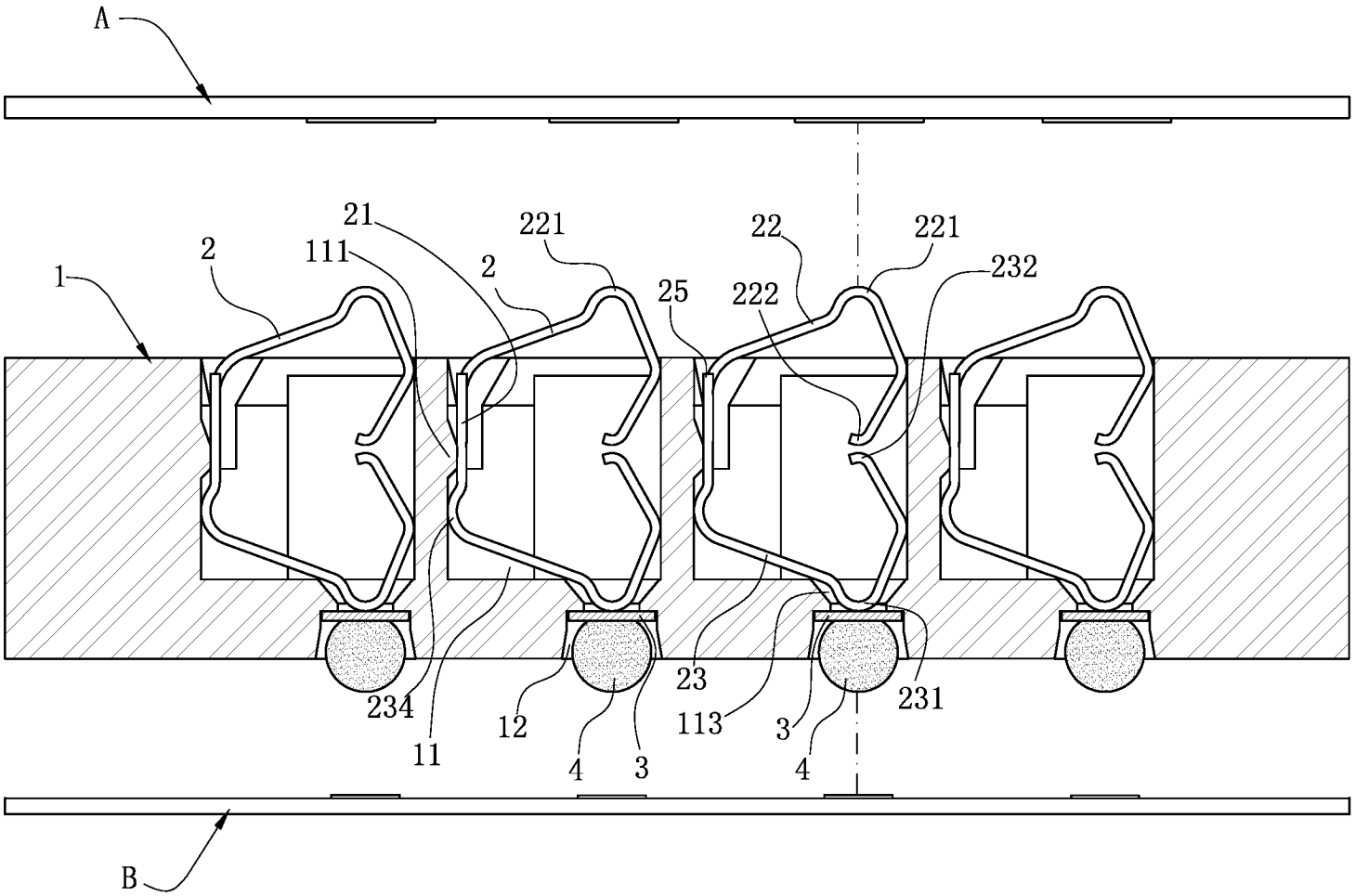
FIG. 3 is a front view of the electrical connector of FIG. 1 before a chip module is pressed downward.

As shown in FIG. 1 and FIG. 3, each accommodating hole 11 has a substantially rectangular shape, and a stopping block 111 protrudes from an end wall of the accommodating hole 11 in a horizontal longitudinal direction for limiting the corresponding conductive terminal 2 from excessively moving upward. Two position limiting grooves 112 are concavely formed on two side walls adjacent to the end wall for limiting the corresponding conductive terminals 2 from excessively moving downward. The two position limiting grooves 112 are symmetrically provided. A recess 113, which is funnel-shaped, is downward concavely formed on a bottom surface of the accommodating hole 11, with its width being gradually shrinking from top to bottom thereof. The recess 113 is communicated downward with the receiving groove 12. As shown in FIG. 2, in the present embodiment, the receiving groove 12 has a substantially cube shape for accommodating the corresponding electrical conductor 3 and the corresponding solder 4. A top wall of the receiving groove 12 is penetrated by the recess 113.

As shown in FIG. 1 and FIG. 3, each conductive terminal 2 is substantially C-shaped, and is made of a metal material. The conductive terminal 2 has a flat plate shaped base 21. An upper elastic arm 22 is connected above the base 21 and obliquely extending upward and forward. A top end of the upper elastic arm 22 has a contact portion 221. The contact portion 221 is used to be in contact with a conductive pad (not labeled) of the chip module A. A first abutting portion 222 is connected below the contact portion 221. The upper elastic arm 22 is provided with a slot 223 from the contact portion 221 to the first abutting portion 222. The slot 223 divides the contact portion 221 into two portions, such that two different contact points are provided between the contact portion 221 and the chip module A. The upper elastic arm 22 between the contact portion 221 and the first abutting portion 222 bends away from the base 21 and abuts the insulating body 1. A lower elastic arm 23 is connected below the base 21 and obliquely extending downward and forward. The lower elastic arm 23 has a stopping portion 234 connected below the base 21. The stopping portion 234 protrudes toward the end wall and is located below the stopping block 111 to limit the corresponding conductive terminal 2 from excessively moving upward. A bottom end of the lower elastic arm 23 has a conducting portion 231 to be in contact with the electrical conductor 3 through the recess 113. A second abutting portion 232 is connected above the conducting portion 231. In the present embodiment, before the chip module A is pressed downward to be mated, the second abutting portion 232 is not in contact with the first abutting portion 222. In other embodiments, before the chip module A is pressed downward to be mated, the second abutting portion 232 and the first abutting portion 222 are in contact with each other in advance. The lower elastic arm 23 is provided with an opening 233 from the conducting portion 231 to the second abutting portion 232. The opening 233 divides the conducting portion 231 into two portion, such that two different contact points are provided between the conducting portion 231 and the electrical conductor 3. The lower elastic arm 23 between the conducting portion 231 and the second abutting portion 232 bends away from the base 21 and abuts the insulating body 1. In the present embodiment, the upper elastic arm 22 and the lower elastic arm 23 are vertically symmetrical. Two position limiting portions 24 are protrudingly provided at two sides of the base 21. The position limiting grooves 112 accommodate the two position limiting portions 24 to limit the corresponding conductive terminal 2 from excessively moving downward, and a strip connecting portion 25 extends upward from the position limiting portions 24 for connecting a strip (not shown). The conductive terminals 2 may moderately move in the corresponding accommodating holes 11 in a vertical direction under the restriction of both the stopping blocks 111 and the position limiting grooves 112.

As shown in FIG. 1 and FIG. 2, in the present embodiment, each electrical conductor 3 is a flat plate shaped rectangular body, and is made of a metal plate. Preferably, the electrical conductors 3 are made of a copper alloy, and the electrical conductors 3 are more wear-resistant as compared to the conductive terminals 2. In other embodiments, the material of the electrical conductors 3 may be other alloys or conductive materials capable of satisfying its electrical conductivity, and is not limited thereto. The electrical conductors 3 are assembled in the receiving grooves 12, and each electric conductor 3 may be fixed to the corresponding receiving groove 12 by an adhesive or may be fixed in the corresponding receiving groove 12 by interference fit with the insulating body 1. In other embodiments, the electrical conductors 3 may be injection-molded with the insulating body 1. The size of each electrical conductor 3 is larger than the size of an opening of the recess 113 in a top wall of the corresponding receiving groove 12, such that the electrical conductor 3 is limited by the top wall of the receiving groove 12 and cannot enter the accommodating hole 11. An upper surface of each electrical conductor 3 abuts the conducting portion 231, a lower surface of each electrical conductor 3 is soldered with the solder 4, and the solder 4 is soldered to a conductive pad (not labeled) of the circuit board B.

In the present embodiment, each solder 4 is a solder ball. In other embodiments, each solder 4 may also be a solder paste. The solders 4 may be fixed on the circuit board B in advance, or may also be fixed to the electrical conductors 3 in advance. Alternatively, other forms of solders 4 may be added in other manners.

Before the chip module A is pressed downward and mated with the electrical connector 100, the base 21 may moderately move in the corresponding accommodating hole 11 in a vertical direction, but the conducting portion 231 maintains in contact with the corresponding electrical conductor 3. Such arrangement ensures that the conducting portion 231 and the corresponding electrical conductor 3 achieve a stable contact.

Figure 4:
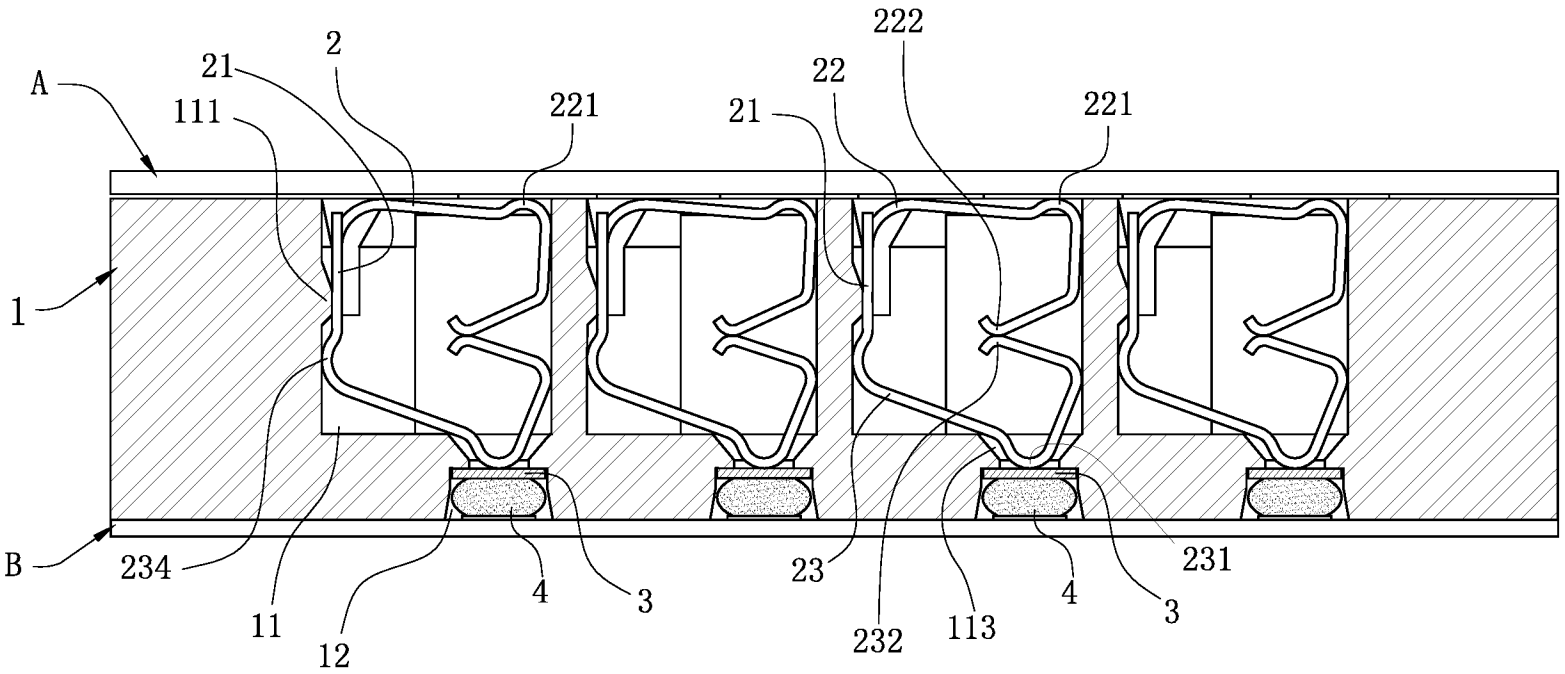
FIG. 4 is a schematic view of the electrical connector of FIG. 3 after the chip module is pressed downward.

As shown in FIG. 4, the chip module A is pressed downward and mated with the electrical connector 100 mounted on the circuit board B. The solders 4 are completely accommodated in the receiving grooves 12 after soldering fusion. The insulating body 1 downward abuts the circuit board B, and the lower surface of each electrical conductor 3 is soldered to the circuit board B through the corresponding solder 4. When the chip module A is completely pressed downward, the chip module A downward abuts the insulating body 1, the chip module A abuts the contact portion 221, and the first abutting portion 222 downward abuts the second abutting portion 232, so as to form a first conductive path sequentially passing through the chip module A, the contact portion 221, the upper elastic arm 22, the base 21, the lower elastic arm 23, the conducting portion 231, the electrical conductor 3 and the circuit board B, and a second conductive path sequentially passing through the chip module A, the contact portion 221, the first abutting portion 222, the second abutting portion 232, the conducting portion 231, the electrical conductor 3 and the circuit board B between the chip module A and the circuit board B. The first conductive path and the second conductive path are provided in parallel, and have a small self-inductance effect, which reduces the electrical impedance between the chip module A and the circuit board B during the telecommunication transmission, thereby ensuring the good electrical conduction and telecommunication transmission performance between the chip module A and the circuit board B.

Figure 5:
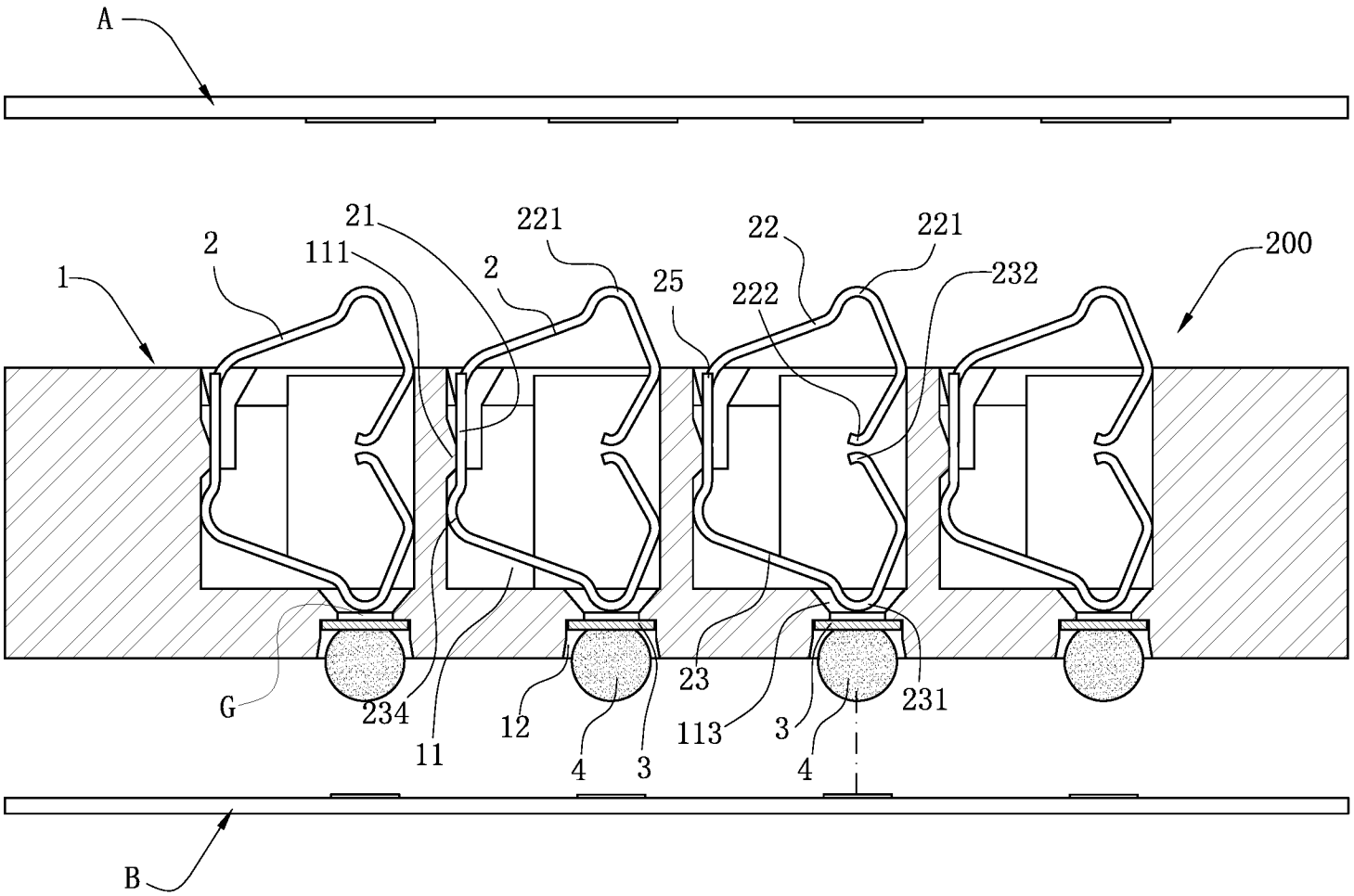
FIG. 5 is a schematic view of an electrical connector according to a second embodiment of the present invention.
Figure 6:
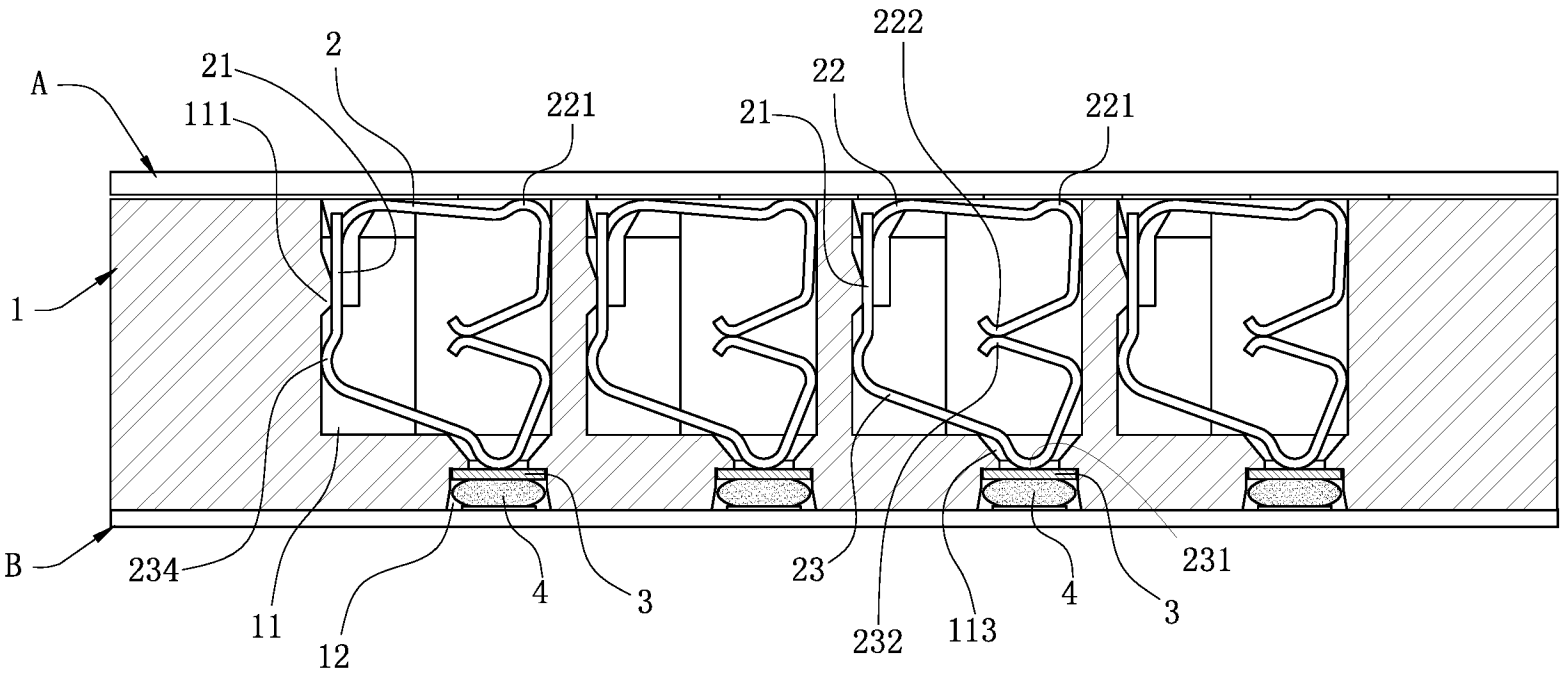
FIG. 6 is a schematic view of the electrical connector of FIG. 5 after the chip module is pressed downward.
Figure 7:
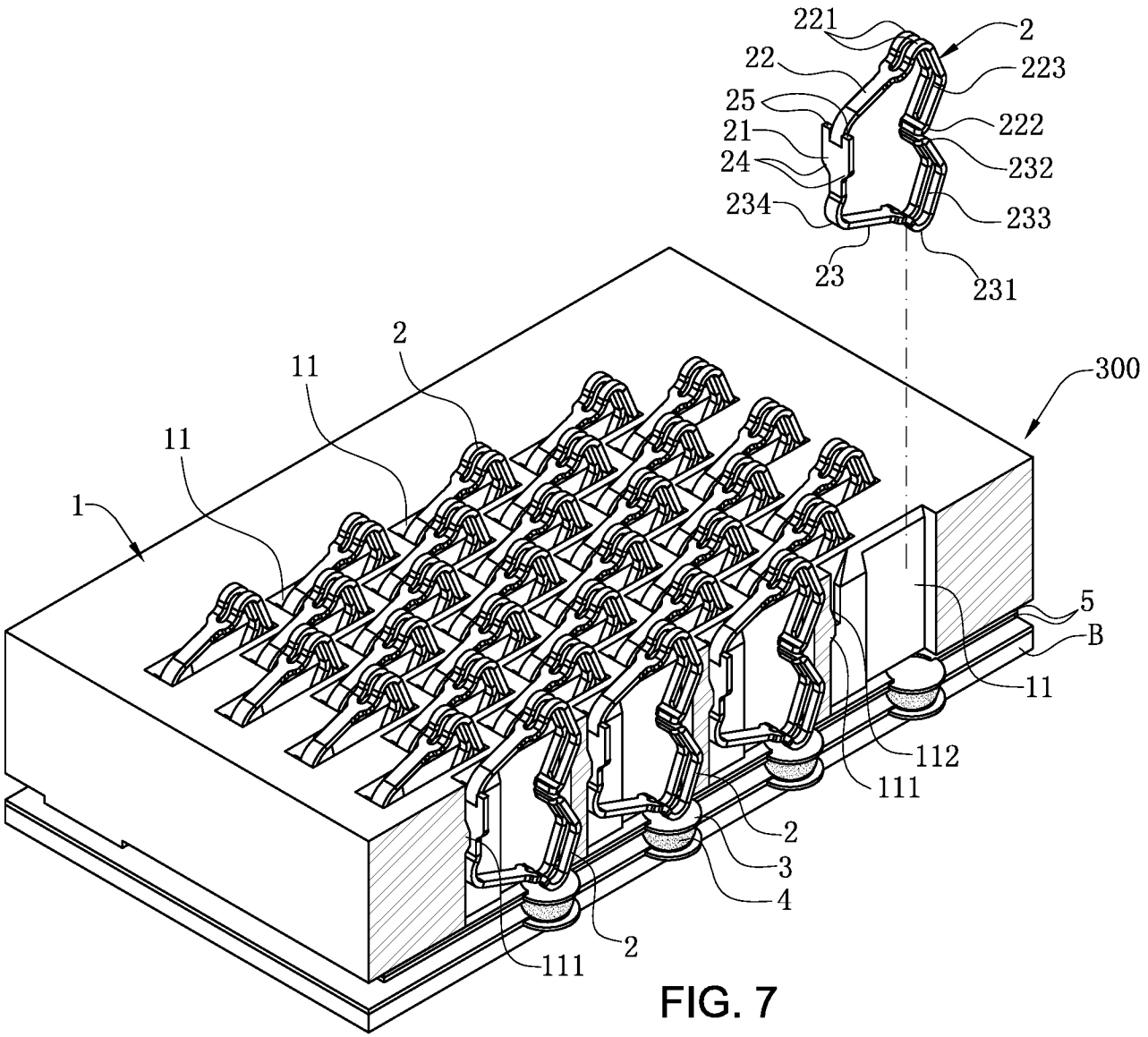
FIG. 7 is a perspective view of an electrical connector according to a third embodiment of the present invention.
Figure 8:
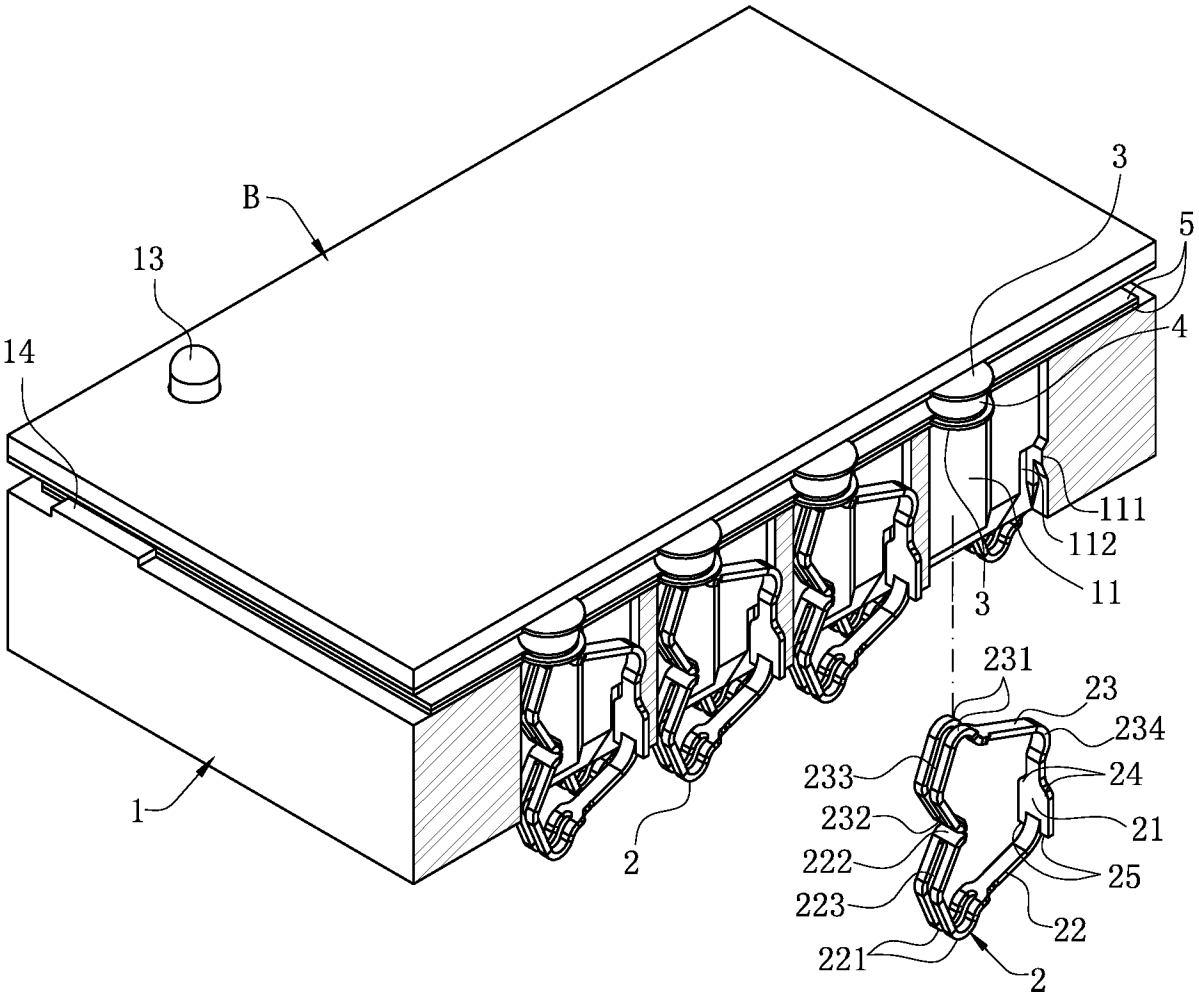
FIG. 8 is a perspective view of the electrical connector of FIG. 7 being 180° inverted.

FIG. 5 and FIG. 6 show an electrical connector 200 according to a second embodiment of the present invention, which is different from the first embodiment mainly in that: before the chip module A is pressed downward, a gap G is provided between the conducting portion 231 and the corresponding electrical conductor 3. That is, the conducting portion 231 is not in contact with the corresponding electrical conductor 3. Each conductive terminal 2 may move upward and downward moderately in the corresponding accommodating hole 11, and the distance of the vertical movement is greater than the gap G. The conducting portion 231 is in contact with the corresponding electrical conductor 3 only when the chip module A is pressed downward on the conductive terminals 2.

FIG. 7 to FIG. 11 show an electrical connector 300 according to a third embodiment of the present invention, which is different from the first embodiment mainly in that: the insulating body 1 does not have the receiving grooves 12 for receiving and fixing the electrical conductors 3. The accommodating holes 11 run through the lower surface of the insulating body 1 from the upper surface of the insulating body 1. The conducting portion 231 protrudes from the lower surface of the insulating body 1. A flexible substrate 5 is provided between the insulating body 1 and the circuit board B, and the electrical conductors 3 are fixed in the flexible substrate 5. In the present embodiment, each electrical conductor 3 has a circular sheet shape.

Figure 9:
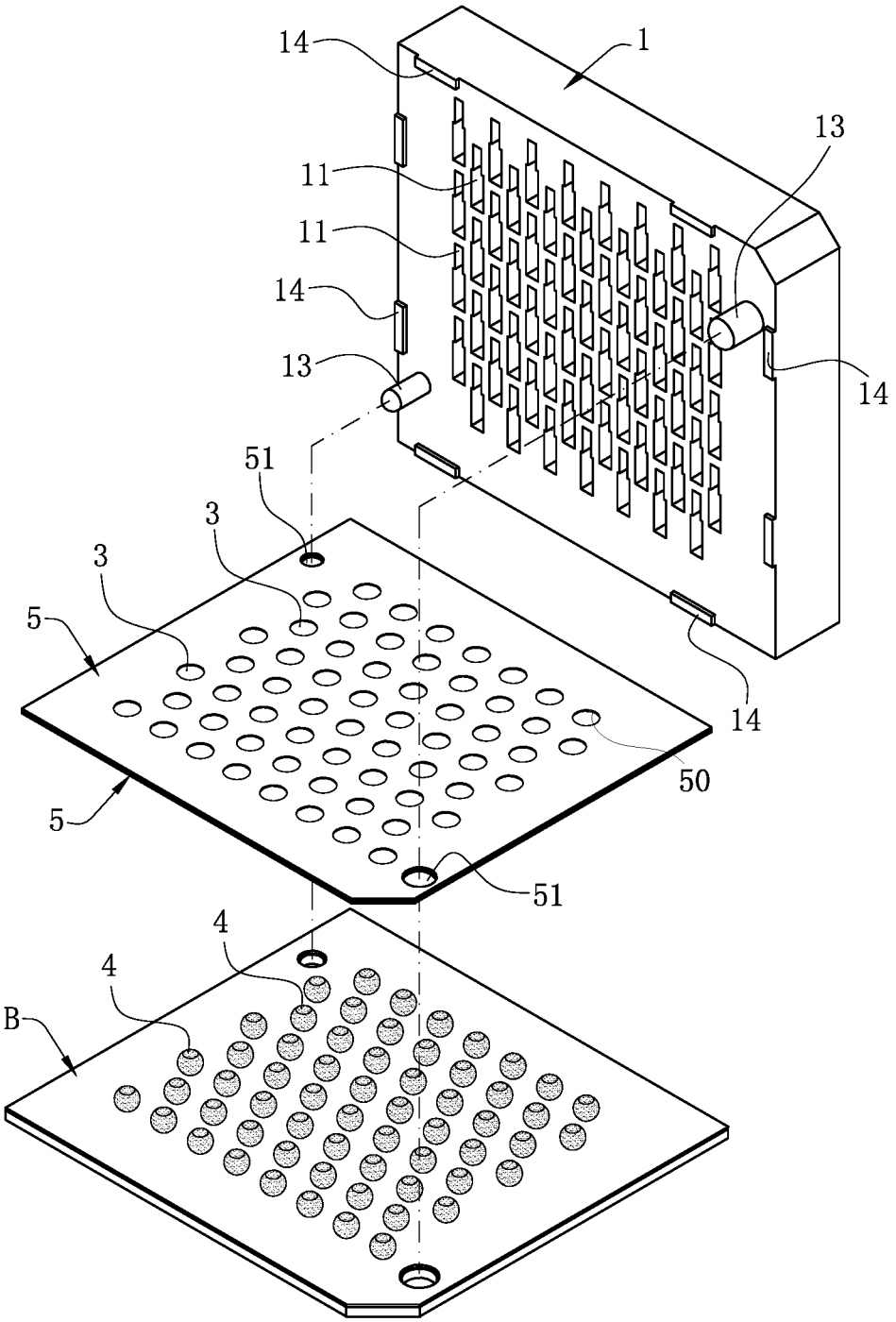
FIG. 9 is a perspective exploded view of an insulating body, a flexible substrate and a circuit board of FIG. 7.
Figure 10:
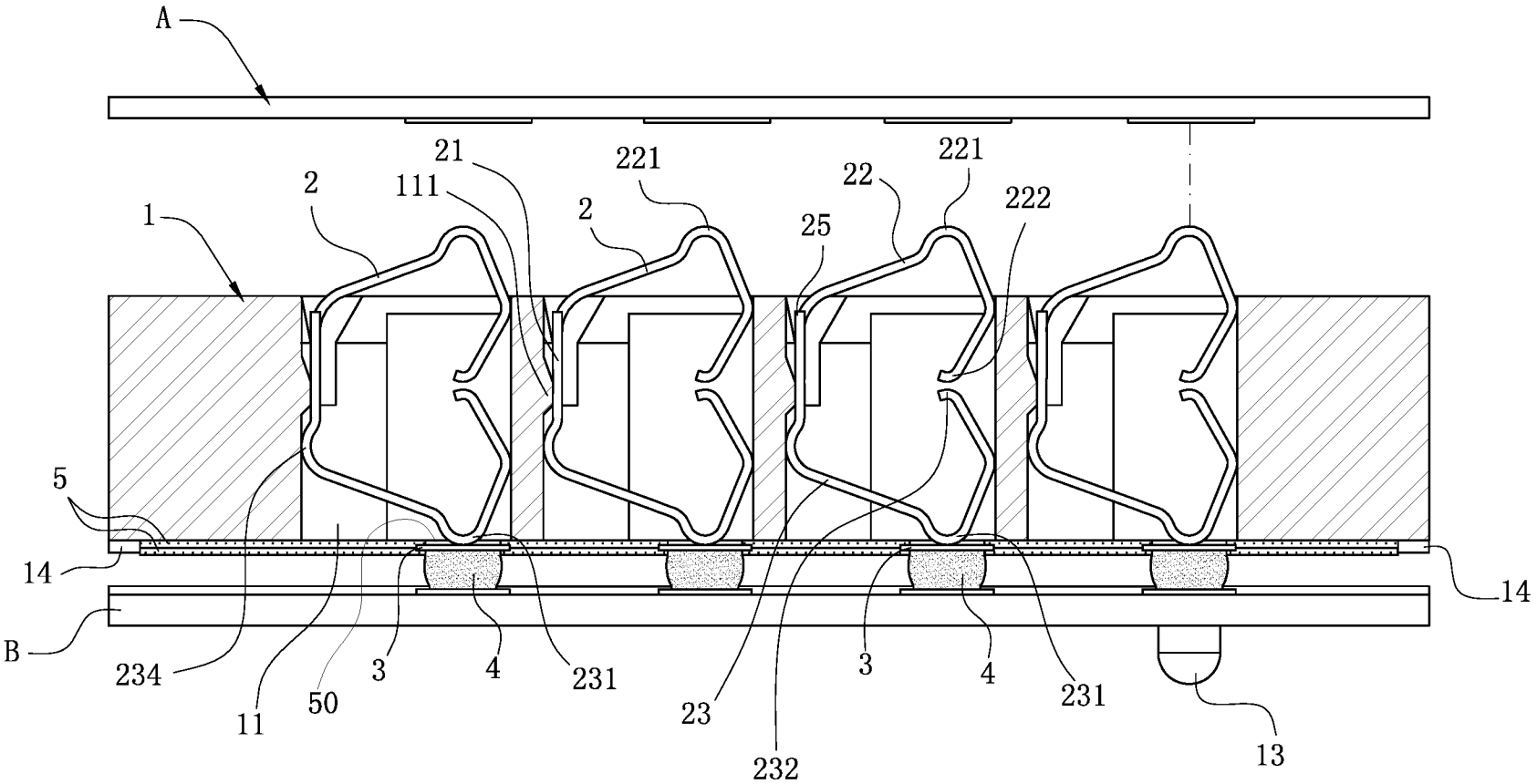
FIG. 10 is a front view of the electrical connector of FIG. 7 before the chip module is pressed downward.
Figure 11:
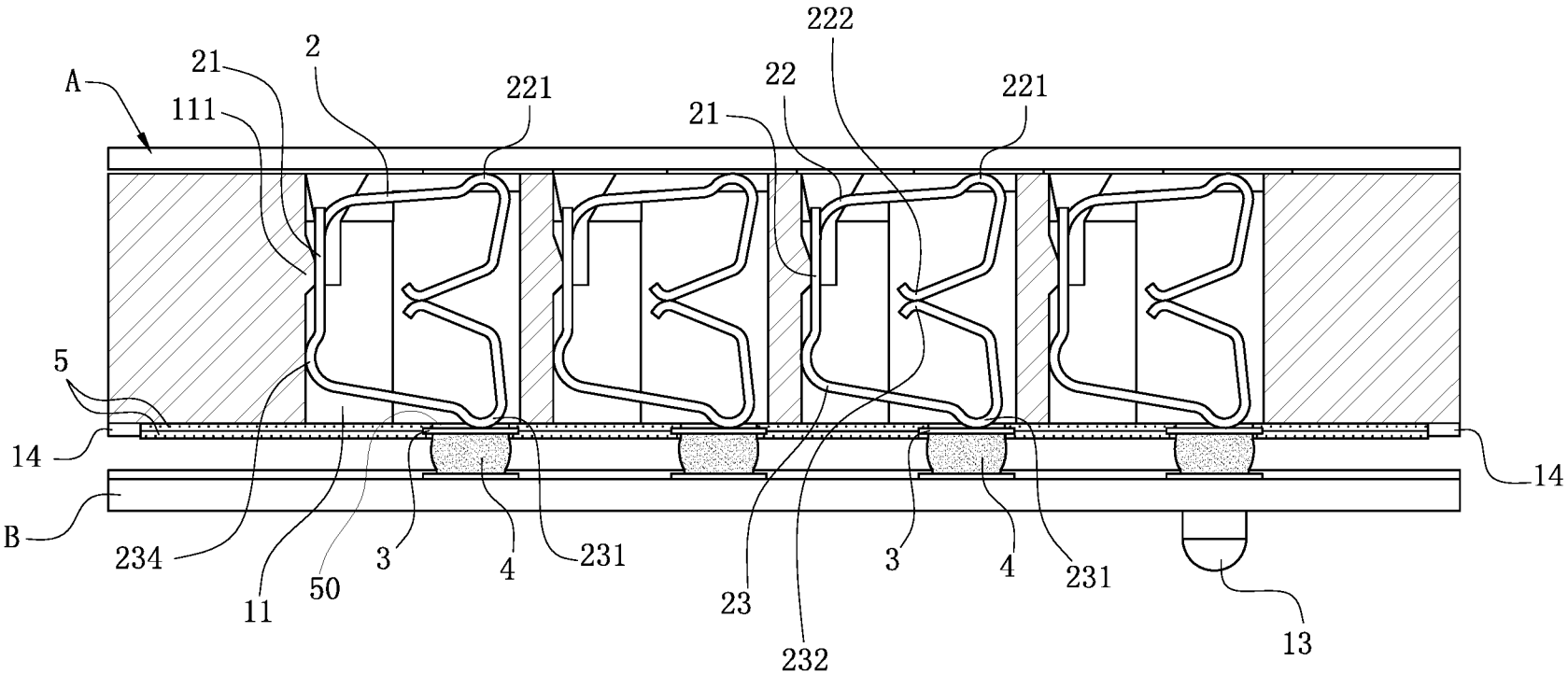
FIG. 11 is a schematic view of the electrical connector of FIG. 10 after the chip module is pressed downward.

As shown in FIG. 9 and FIG. 10, the flexible substrate 5 is made of an insulating material. In the present embodiment, a mylar is preferably used. The flexible substrate 5 is formed by two flexible sub-boards (not labeled) attached to each other vertically. The electrical conductors 3 are sandwiched between the two flexible sub-boards below the accommodating holes 11. The electrical conductors 3 are exposed on an upper surface and a lower surface of the flexible substrate 5. That is, the upper and lower surfaces of the flexible substrate 5 simultaneously concavely form two grooves 50 toward each electrical conductor 3, such that the conducting portion 231 abuts the upper surface of the corresponding electrical conductor 3 through the groove 50 above the corresponding electrical conductor 3. Each solder 4 is filled in the groove 50 below the corresponding electrical conductor 3 to be in contact with the lower surface of the corresponding electrical conductor 3 so as to electrically connect the corresponding electrical conductor 3 to the circuit board B, thus facilitating the electrical connection between the conductive terminals 2 and the circuit board B. In other embodiments, the electrical conductor 3 may directly abut the conductive pads of the circuit board B to achieve the electrical connection without soldering the solders 4.

As shown in FIG. 9, the shape of the flexible substrate 5 is similar to the shape of the lower surface of the insulating body 1. Two positioning posts 13 of different sizes protrude downward from the lower surface of the insulating body 1. A plurality of positioning blocks 14, which are strip-shaped, protrude downward from the periphery of the lower surface of the insulating body 1. The two positioning posts 13 are located at two opposite corners of the lower surface of the insulating body 1. The flexible substrate 5 has two positioning holes 51 of different sizes corresponding to the two positioning posts 13, and the sizes of the two positioning holes 51 are respectively matched with the sizes of the two positioning posts 13. As shown in FIG. 10, the flexible substrate 5 is assembled and attached to the lower surface of the insulating body 1. The two positioning posts 13 of different sizes correspondingly penetrate through the two positioning holes 51 matched therewith for achieving a fool-proof effect. The inner sides of the positioning blocks 14 abut a plurality of edges of the flexible substrate 5 to hold the flexible substrate 5 in a horizontal direction to avoid the flexible substrate 5 from moving horizontally, such that each electrical conductor 3 is aligned with the conducting portion 231 in a vertical direction. In the present embodiment, the positioning posts 13 also run through the circuit board B (see FIG. 8 for assistance).

The electrical connector according to certain embodiments of the present invention has the following beneficial effects.

In the first embodiment and the second embodiment, the electrical conductors 3 are accommodated in the receiving grooves 12 of the insulating body 1. The positions of the electrical conductors 3 and the conductive terminals 2 are relatively fixed in a horizontal direction, and the electrical conductors 3 are more wear-resistant. In the third embodiment, the electrical conductors 3 are fixed in the flexible substrate 5, and the horizontal displacement of the flexible substrate 5 is limited by the positioning posts 13 and the positioning blocks 14 on the lower surface of the insulating body 1. Thus, the positions of the electrical conductors 3 and the conductive terminals 2 are relatively fixed in the horizontal direction, and the electrical conductor 3 is more wear-resistant. Therefore, in each embodiment, the electrical conductivity of the electrical conductors 3 will not be affected due to the electrical conductors 3 and the conductive terminals 2 scratching with each other.

Only one electrical connector 3 is used to electrically connect the conductive terminal 2 and a solder 4 or a circuit board B, such that an additional capacitive effect is not generated, thus facilitating regulation of the impedance of a conductive path.

Each solder 4 is soldered to the flat plate shaped electrical conductor 3. Comparing to the case where a solder 4 is directly soldered to the conducting portion 231 bending upward, the solder 4 is not easy to break, and the conducting portion 231 is then pressed against the corresponding electrical conductor 3, ensuring that the conductive terminals 2 is stably and electrically connected to the circuit board B.

The impedance of the entire conductive path can be adjusted by changing the impedance of the electrical conductor 3, which is easier for implementation than adjusting the impedance of the entire conductive path by changing the conductive terminal 2.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, mounted on a circuit board and configured to mate with a chip module, the electrical connector comprising:

an insulating body, provided with an accommodating hole;

a conductive terminal, accommodated in the accommodating hole, wherein the conductive terminal has a conducting portion; and an electrical conductor, provided below the conducting portion, configured to be in contact with the conducting portion and electrically connected to the circuit board, wherein a gap is provided between the conducting portion and the electrical conductor, and when the chip module is pressed downward on the conductive terminal, the conductive terminal moves downward, and the conducting portion downward abuts the electrical conductor.

2. The electrical connector according to claim 1, wherein a lower surface of the insulating body is upward concavely provided with a receiving groove, the receiving groove is located below the accommodating hole and is communicated with the accommodating hole, and the electrical conductor is fixed in the receiving groove.

3. The electrical connector according to claim 2, wherein a bottom surface of the accommodating hole is downward concavely formed with a recess gradually shrinking from top to bottom thereof, the recess is communicated with the receiving groove, and the conducting portion enters the recess.

4. The electrical connector according to claim 1, wherein the electrical conductor is made of metal.

5. The electrical connector according to claim 1, wherein the electrical conductor is connected to the circuit board through a solder.

6. The electrical connector according to claim 1, wherein the conducting portion abuts the electrical conductor.

7. The electrical connector according to claim 1, wherein the conductive terminal has a base, an upper elastic arm is provided above the base and obliquely extending upward and forward, the upper elastic arm has a contact portion, the contact portion is configured to be in contact with the chip module, a first abutting portion is connected below the contact portion, a lower elastic arm is provided below the base and obliquely extending downward and forward, the lower elastic arm has the conducting portion, and a second abutting portion is connected above the conducting portion.

8. The electrical connector according to claim 7, wherein the upper elastic arm has a slot between the contact portion and the first abutting portion, and the lower elastic arm has an opening between the conducting portion and the second abutting portion.

9. The electrical connector according to claim 7, wherein an end wall of the accommodating hole is protrudingly provided with a stopping block, the lower elastic arm has a stopping portion connected below the base, the stopping portion protrudes toward the end wall and is located below the stopping block, the accommodating hole is concavely provided with a position limiting groove at one side of the base, and the base is protrudingly provided with a position limiting portion to be accommodated in the position limiting groove.

10. The electrical connector according to claim 7, wherein the first abutting portion is in contact with the second abutting portion only when the chip module is pressed downward on the conductive terminal.

11. An electrical connector, mounted on a circuit board, comprising:

an insulating body, provided with an accommodating hole;

a conductive terminal, accommodated in the accommodating hole, wherein the conductive terminal has a conducting portion;

a flexible substrate, located below the insulating body; and an electrical conductor, provided on the flexible substrate and located below the conducting portion, wherein the electrical conductor is exposed on an upper surface and a lower surface of the flexible substrate to electrically connect the conducting portion and the circuit board, an upper surface of the electrical conductor is in contact with the conducting portion, and a lower surface of the electrical conductor is soldered to the circuit board through a solder.

12. The electrical connector according to claim 11, wherein the flexible substrate is formed by two flexible sub-boards attached to each other, the electrical conductor is fixed between the two flexible sub-boards, and the upper surface and the lower surface of the flexible substrate concavely form two grooves toward the electrical conductor to expose the electrical conductor.

13. The electrical connector according to claim 11, wherein the insulating body is downward protrudingly provided with a plurality of positioning blocks abutting an edge of the flexible substrate, so as to limit the flexible substrate from moving horizontally.

14. The electrical connector according to claim 11, wherein the conductive terminal has a base, an upper elastic arm is provided above the base and obliquely extending upward and forward, the upper elastic arm has a contact portion, the contact portion is configured to be in contact with a chip module, a first abutting portion is connected below the contact portion, a lower elastic arm is provided below the base and obliquely extending downward and forward, the lower elastic arm has the conducting portion, and a second abutting portion is connected above the conducting portion.

* * * * *